US005123527A

United States Patent [19]

Hustad

[11] Patent Number: 5,123,527

[45] Date of Patent: Jun. 23, 1992

[54] FOOD PACKAGE HAVING A SLEEVE ENCLOSURE AND A RIGID BASE TRAY

[75] Inventor: Gerald O. Hustad, McFarland, Wis.

[73] Assignee: Oscar Mayer Foods Corporation, Madison, Wis.

[21] Appl. No.: 653,915

[22] Filed: Feb. 12, 1991

[51] Int. Cl.[5] ..... B65D 75/00

[52] U.S. Cl. ..... 206/45.31; 206/549; 206/806; 229/902; 426/119

[58] Field of Search ..... 206/44 R, 45.24, 45.25, 206/45.26, 45.31, 521, 525, 541-549, 806; 219/10.55 E; 229/902-904, 906; 426/107, 113, 234, 243, 119

[56] References Cited

U.S. PATENT DOCUMENTS

| | | | |
|---|---|---|---|
| D. 265,551 | 7/1982 | Colby et al. . | |
| D. 282,821 | 3/1986 | Noyes . | |
| D. 284,939 | 8/1986 | Sandish et al. . | |
| D. 305,204 | 12/1989 | Reifein et al. . | |
| D. 305,205 | 12/1989 | Grindrod et al. . | |
| 1,840,439 | 1/1932 | Ewell | 206/45.24 |
| 2,023,542 | 12/1935 | Peck | 206/806 |
| 2,106,276 | 1/1938 | Heineman . | |
| 2,133,701 | 10/1938 | Holmes et al. | 206/620 |
| 2,541,173 | 2/1951 | Moore . | |
| 2,755,982 | 7/1956 | Lugt, Jr. . | |
| 2,790,589 | 4/1957 | Moore . | |
| 2,899,123 | 8/1959 | Currie, Jr. . | |
| 3,203,541 | 8/1965 | Rein . | |
| 3,281,051 | 10/1966 | O'Brien et al. . | |
| 3,411,696 | 11/1968 | Ayer et al. . | |
| 3,423,005 | 1/1969 | Leibson et al. . | |
| 3,443,681 | 5/1969 | Wysocki | 206/44 R |
| 3,487,918 | 1/1970 | Roden et al. . | |
| 3,604,560 | 9/1971 | Farguhar . | |
| 3,618,848 | 11/1971 | Pawlowski . | |
| 3,648,918 | 3/1972 | Van Inwagen . | |
| 3,658,240 | 4/1972 | Stoll . | |
| 3,756,502 | 9/1973 | Swanson et al. | 206/620 |
| 3,759,720 | 9/1973 | Young | 206/545 |
| 3,784,000 | 1/1974 | Brown . | |
| 4,013,798 | 3/1977 | Goltsos | 219/10.55 E |
| 4,122,324 | 10/1978 | Falk | 426/234 |
| 4,221,320 | 9/1980 | Faller . | |
| 4,241,863 | 12/1980 | Faller . | |
| 4,315,569 | 2/1982 | Jaeschke | 206/806 |
| 4,588,078 | 5/1986 | Ferrero . | |
| 4,671,453 | 1/1987 | Cassidy . | |
| 4,674,633 | 6/1987 | Steadman . | |
| 4,703,148 | 10/1987 | Mikulski et al. . | |
| 4,785,160 | 11/1988 | Hart | 426/113 |
| 4,821,884 | 4/1989 | Griffin et al. . | |
| 4,836,439 | 6/1989 | Hart | 229/903 |
| 4,880,115 | 11/1989 | Chaussadas . | |
| 4,925,035 | 5/1990 | Hunninghaus | 229/906 |
| 4,944,603 | 7/1990 | Cornish et al. . | |
| 4,961,494 | 10/1990 | Alexander | 206/45.24 |
| 4,971,494 | 10/1990 | Alexander . | |

FOREIGN PATENT DOCUMENTS

| | | | |
|---|---|---|---|
| 1082655 | 7/1980 | Canada | 206/459 |
| 2451394 | 5/1976 | Fed. Rep. of Germany | 219/10.55 E |
| 0058934 | 3/1989 | Japan | 219/10.55 E |
| 1189877 | 4/1970 | United Kingdom . | |

OTHER PUBLICATIONS

Oscar Mayer Foods Corp.; "Lunch Packs" around 1988.

*Primary Examiner*—Jimmy G. Foster
*Attorney, Agent, or Firm*—Joseph T. Harcarik

[57] ABSTRACT

A food package having a rigid base tray formed of resilient material and having a plurality of recessed compartments, at least some of said recessed compartments containing food products and being air-tightly sealed with a flexible film. The rigid base tray is enclosed within a sleeve which includes front and back panels connected together by upper side and lower side panels. The sleeve may include a feature permitting the package to be displayed upright. The sleeve would include a structure for easily breaking the sleeve so that the consumer can easily reach the contents of the rigid base tray.

18 Claims, 10 Drawing Sheets

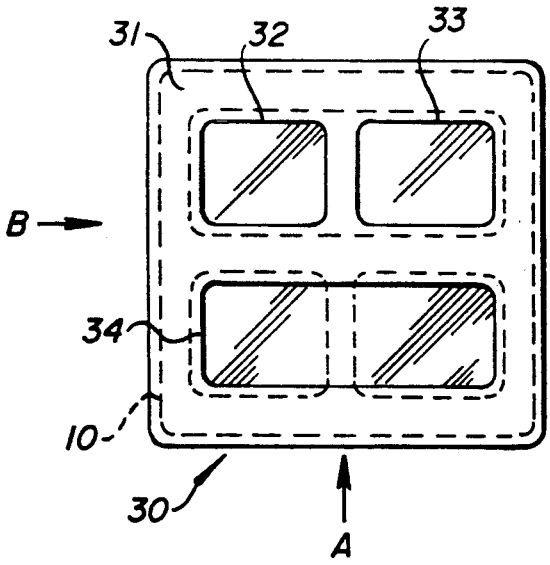
FIG. 3
FIG. 4
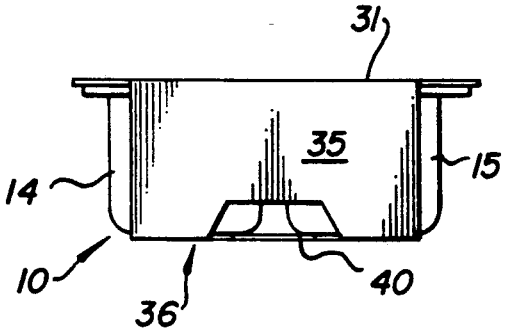
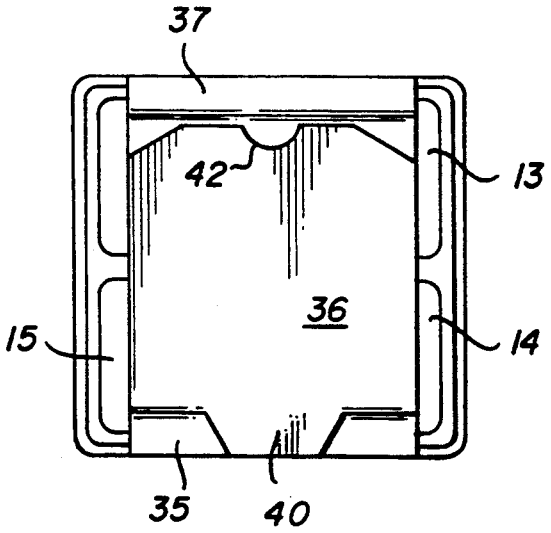
FIG. 6
FIG. 5
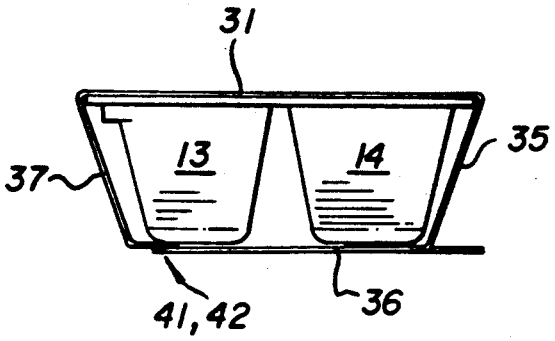

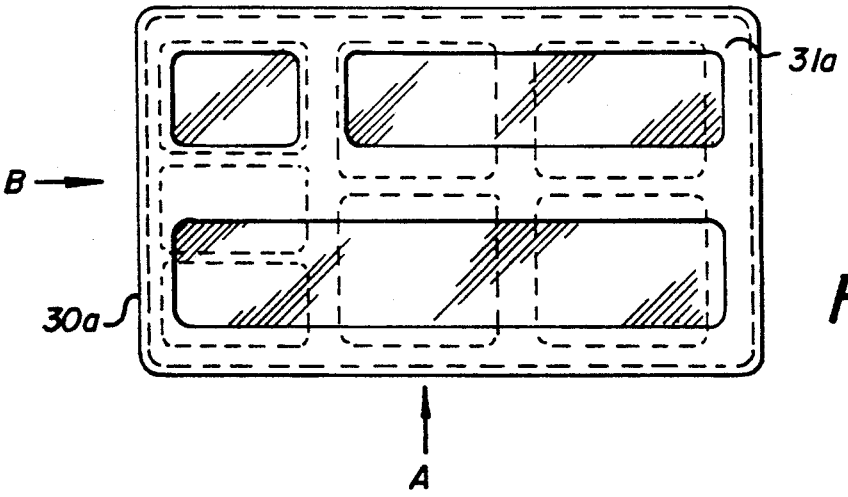
FIG. 8
FIG. 9
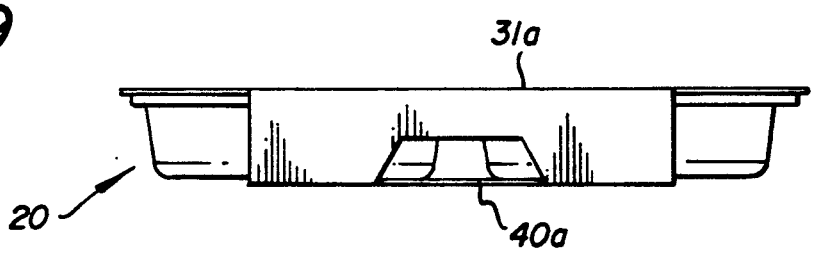
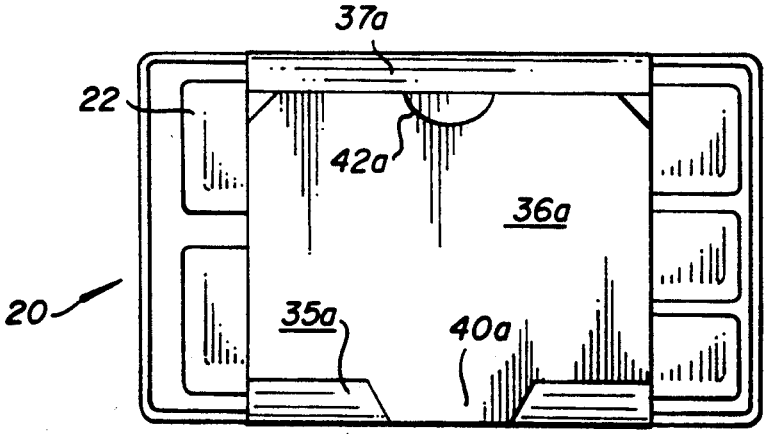
FIG. 11
FIG. 10
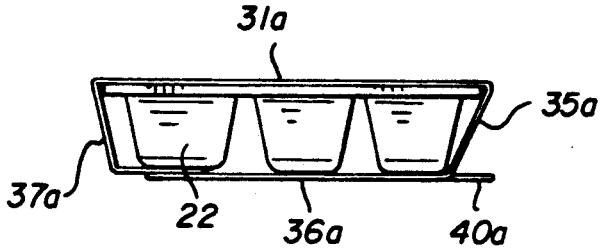

FOOD PACKAGE HAVING A SLEEVE ENCLOSURE AND A RIGID BASE TRAY

FIELD OF THE INVENTION

This application relates to packages, and in particular it relates to a food package having a hermetically sealed compartmentalized rigid base tray.

BACKGROUND OF THE INVENTION

Various food packages are known which contain food in a form which is visible to the purchasing consumer. One such package comprises a rigid base tray having food receiving compartments therein and covered with a transparent flexible film which hermetically seals the compartments. When the package is to travel in ordinary channels of commerce between the original manufacturer and the supermarket shelf, there is a need to provide, in addition to the basic food containing and sealing function of the container, a means to convey label information to the consumer, to provide a mechanism which allows the package to stand on edge or otherwise be displayed in an upright position and/or to preserve the structural integrity of the package.

Heretofore, in a package of the present type, these functions have been provided by an outer closure container such as that shown in U.S. Pat. Nos. Dec. 305,204 and Dec. 305,205. However, since outer enclosure containers use a large amount of material, they tend to be relatively expensive. Also, for environmental purposes, it is desirable to minimize the quantity of packaging material required for any given food product and/or to use materials which facilitate recycling and are therefore "environmental friendly". Additionally, consumers often favor packages using less packaging material because they enhance visibility of the product.

One technique used heretofore to enclose packages is a wrap around collar as described in commonly owned U.S. application Ser. No. 07/453,290, filed Dec. 22, 1989. However, since this collar is of relatively thin width, it does not cover the entire top or the entire bottom and hence it does not simulate the appearance of an outer enclosure container and its ability to enhance the structural integrity of the package is limited. Also, it is known to use a full width sleeve to enclose a rigid tray, as shown in U.S. Pat. No. 4,221,320 to Faller. However, full width sleeves as shown in Faller are not used in combination with compartmentalized rigid base trays and do not permit viewing of products within the rigid base tray.

Thus, there exists a need to provide, for a package of the present type, improvements in outer enclosures which utilize less material than the known outer enclosure containers, while concurrently providing an adequate area for label information, providing structural integrity to the package and also permitting viewing of the food products within the compartments of the rigid base tray. The enclosure should also preferably provide a means to allow the package to be displayed in an upright position.

SUMMARY OF THE INVENTION

According to the present invention, a food package is provided which comprises a compartmentalized rigid base tray which holds the food products and is covered by a flexible film which hermetically seals the compartments. For convenience, the plane of the rigid base tray which includes the flexible film will be referred to as the front of the package, reflecting the most common orientation of the package on the grocery store shelf wherein the package is generally displayed with the plane of the film vertical and facing the consumer. The opposite surface of the rigid base tray, often referred to as the bottom, will be referred to herein as the back of the rigid base tray. Consistent therewith, the sides of the rigid base tray are then oriented as an upper side, a lower side and left and right sides.

According to the present invention, there is provided in combination with a rigid base tray of the type described a sleeve enclosure which wraps around the front, the upper side, the back and the lower side of the rigid base tray.

All aspects of the rigid base tray, including its dimensions and the materials used therein which are selected for structural integrity, to preserve the quality of the food products and to maximize recyclability and thereby provide an environmental friendly package are all as described in commonly owned co-pending U.S. application Ser. No. 07/609,533, filed Nov. 6, 1990. Accordingly, the discussion therein concerning all structural aspects of the rigid base tray itself are incorporated by reference herein.

In accordance with a primary purpose of the present invention, there is provided, in combination with a rigid base tray of the type described, an enclosing sleeve which wraps around the front, upper side, back and lower side of the rigid base tray. Either the front panel or the back panel of the sleeve preferably covers the entire area of the front and/or back of the base tray, respectively. Such a "full faced" sleeve panel serves several purposes.

First, whether on the front panel or the back panel, it provides significant structural integrity to the package, which in fact may have the additional advantage of permitting the use of a thinner material for the rigid base tray itself.

Second, a full faced front panel has the advantage of completely simulating the appearance of the front of the prior outer enclosure container. Thus, with such a package standing upright on the grocer's shelf, the package would appear precisely the same to the consumer, i.e., have the same "consumer impact" as an outer enclosure container, but using far less packaging material. Reduction of the packaging material can be achieved because the panels of the sleeve overlying the upper side, back and lower sides of the rigid base tray can be of relatively small width.

In addition to or instead of a full faced front panel, the sleeve can include a full faced back panel. Such a back panel will provide even greater structural integrity than a full faced front panel because a full faced back panel could be adhered to the back of the rigid base tray by suitable means, such as a hot melt adhesive, which would permit the panel to be removed therefrom while concurrently protecting the outer corners of the rigid base tray against damage.

Another purpose of the present invention is to provide, in a combination of a rigid base tray and an enclosing sleeve of the type described, a structure which permits this package to be displayed in the above described vertical orientation on the grocer's shelf. In accordance with one preferred arrangement, a tab is provided in the vicinity of the intersection of the back and lower side panels by cutting out a portion from the lower side panel and having same constitute a downward extension of the back panel so that the bottom of this tab is in line with the lower opposed edge along the reference plane of the front panel, thereby providing a pair of parallel lines on which the package can stand. In the alternative, the sleeve can include a structure in the vicinity of the upper side which forms a header, extending upwardly with a hole therethrough to hang the package on a pegboard.

In accordance with another feature of the present invention, the sleeve should be so constructed as to be easily opened. One easy opening arrangement comprises forming the sleeve with portions which overlap, preferably in the vicinity of the back panel and connected together by an easily openable adhesive. A notch or the like can be provided in one of these overlapping portions of these panels which can be grasped by the consumer to separate these overlapping portions of the sleeve. Alternatively (or concurrently), the sleeve can have perforations at convenient locations such as at one or more of the intersections of the four basic panels (front, upper side, back and lower side) which the consumer can readily tear to get to the rigid base tray. These easy opening features are of course applicable to all of the embodiments described herein.

The sleeve itself is preferably formed of paperboard which provides sufficient stiffness, provides a superior printing surface and which is recyclable. A preferred thickness is 15 point paperboard. In the alternative, if so desired, of course other stiff materials such as stiff plastics and the like can be used.

Thus, it is an object of the present invention to provide a new and improved package of the type comprising a compartmentalized rigid base tray and an outer enclosure therefor in the form of a sleeve.

It is still another object of the present invention to provide a food package of the type described wherein a rigid base tray is encircled by a sleeve enclosure which includes a full faced front and/or back panel.

It is still another object of the present invention to provide a package of the type described including a compartmentalized rigid base tray enclosed by an encircling sleeve enclosure which includes means for permitting the package to be displayed in an upright orientation on the grocer's shelf.

It is still another object of the present invention to provide, in a food package of the type having a compartmentalized rigid base tray encircled by a sleeve enclosure, a means for readily and easily separating the sleeve from the rigid base tray to provide easy access to the latter.

These and other objects of the present invention will become apparent from the detailed description to follow.

BRIEF DESCRIPTION OF THE DRAWINGS

Preferred embodiments of the present invention will now be described with respect to the accompanying drawings, wherein:

FIG. 3 is a front view of a package of the type shown in FIG. 1, and including a sleeve enclosure made in accordance with the present invention.

FIG. 4 is a view taken in the direction of arrow A of FIG. 3 showing the lower side of the package.

FIG. 5 is a view taken in the direction of arrow B of FIG. 3, showing the left side of the package.

FIG. 6 is a back view of the package of FIG. 3.

FIG. 8 is a front view of a package of the type shown in FIG. 2, and including a sleeve enclosure made in accordance with the present invention.

FIG. 9 is a view taken in the direction of arrow A of FIG. 8 showing the lower side of the package.

FIG. 10 is a view taken in the direction of arrow B of FIG. 8, showing the left side of the package.

FIG. 11 is a back view of the package of FIG. 8.

DETAILED DESCRIPTION OF THE PREFERRED EMBODIMENTS

Figure 1:
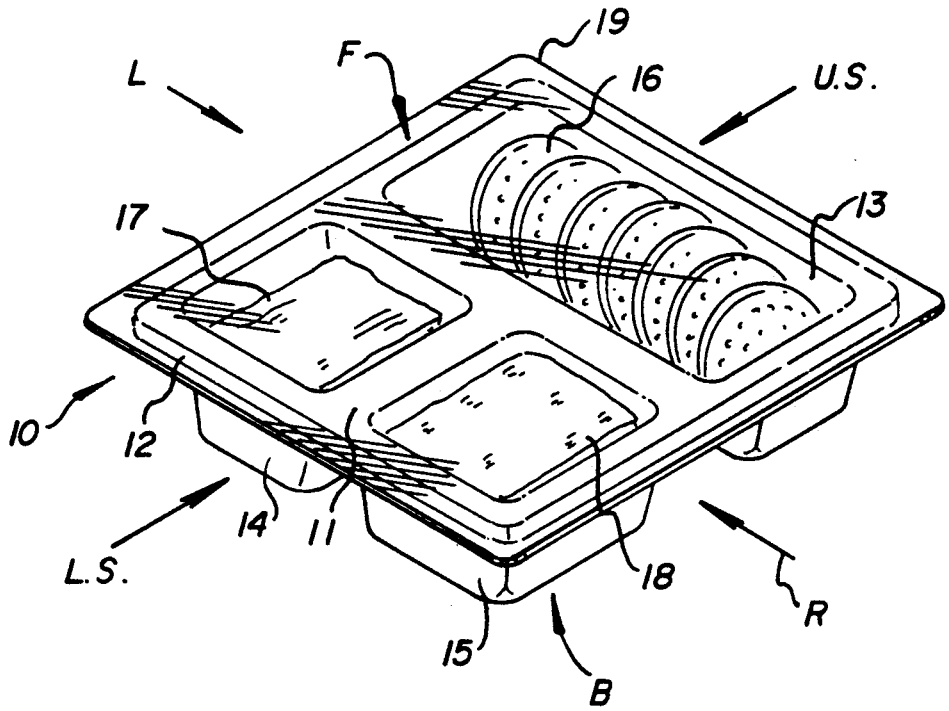
FIGS. 1 and 2 are perspective views of differently shaped compartmentalized rigid base trays of the type used in the food package of the present invention.

Referring now to the drawings, like elements are represented by like numerals throughout the several views.

FIG. 1 illustrates a typical rigid base tray 10. It is preferably formed from a single piece of plastic material and includes flanges 11, including both peripheral flanges extending around the periphery of the package and internal flanges separating the compartments from each other. On the outer periphery, the flanges turn down at a skirt 12. This particular rigid base tray includes a larger compartment 13 and a pair of smaller compartments 14 and 15. The larger compartment generally contains a farinaceous material such as crackers 11 while the smaller compartments 14 and 15 would preferably contain a proteinaceous food such as meat, fish, cheese or the like, as represented at 17 and 18. The compartments would then be air-tightly hermetically sealed by a transparent flexible peelable film 19 which adheres to the flanges 11. In the alternative, if the farinaceous materials such as crackers 16 is provided in its own tearable airtight package, that package can be included within the compartment 13, in which case the flexible film 19 need cover and seal only the other two compartments 14 and 15.

FIG. 1 illustrates the rigid base tray 10 in an essentially horizontal position as if sitting on a table, in which position the consumer would place this rigid base tray when consuming the food therein. Accordingly, the reference plane, i.e., the plane containing the flanges 11 and the flexible film 19, would generally be in a horizontal position. However, as sold in commerce with the rigid base tray enclosed in an outer enclosure, the overall package is generally positioned vertically with the reference plane lying in a front, vertical plane. Accordingly, for convenience, the various sides of the rigid base tray will be described hereinafter based on the orientation as the package generally appears on the grocer's shelf. The reference plane which faces forwardly is identified by the letter F and is referred to hereinafter as the front of the package. The opposite surface B is referred to hereinafter as the back of the package. The four sides are referred to hereinafter by their orientation on the grocer's shelf including the upper side US, the right side R, the lower side LS and the left side L.

Figure 2:
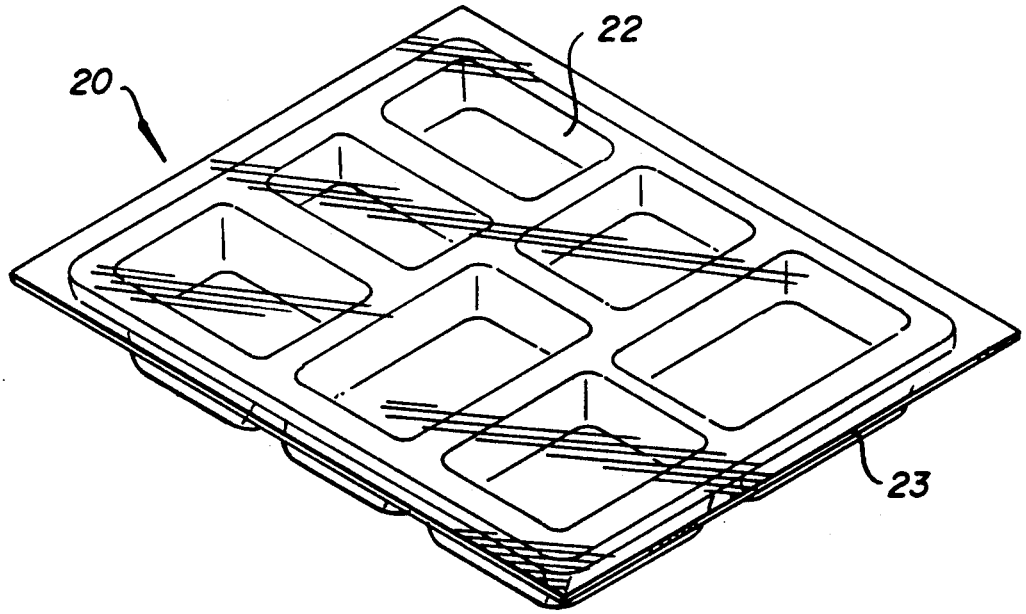

In FIG. 2 as well as all of the remaining figures, the food products themselves will be omitted. It will be understood that in practice these packages can include virtually any food product. Examples include proteinaceous foods such as meat, fish, poultry, cheese, peanut butter, etc. and farinaceous foods such as bread, crackers, etc., condiments, desserts, including confectioneries, fruits, and so on. The compartments may also include implements such as plastic utensils and napkins.

Although FIG. 1 illustrates one configuration of a rigid base tray, it is to be understood that the rigid base tray can have virtually any other configuration. As illustrative of other variations, FIG. 2 illustrates a differently shaped rigid base tray 20 having peripheral and internal flanges 21 and seven compartments 22. The rigid base tray 20 is larger in length and width, but of a shallower depth than the compartments of the tray 10 in FIG. 1. FIG. 2 illustrates a flexible film 23 covering all of the compartments 22, although as noted above, if any of these compartments includes prepackaged crackers or the like, it is not necessary that the flexible film 23 seal or even cover those compartments.

FIGS. 3 through 7 illustrate a first embodiment of the present invention in the form of a sleeve 30 enclosing a rigid base tray 10. This sleeve 30 includes a front 31 having openings 32, 33 and 34 which permit viewing of the contents within the compartments of the rigid base tray 10.

The panels other than the front panel are of smaller width than the front panel. This reduction in packaging material lowers the cost of the package and is preferred for environmental purposes. In this embodiment the other three panels include a back panel 36, a lower side panel 35 and an upper side panel 37.

At the junction between panels 35 and 36 a means is provided to permit the package to stand on that side. For this purpose, and referring also to FIG. 7, at the fold line between panels 35 and 36, a portion of panel 36 projects into the area of panel 35 and is cut on three sides to form a tab 40. Referring to FIGS. 4, 5 and 6, this tab 40 extends outwardly to an edge just beneath the opposed parallel edge of the tray at that side so that these two edges together form a stand, permitting the package to stand upright on that side.

As is apparent from FIG. 3, which illustrates the package in the upright position as it would be viewed by the consumer, this package presents the same visual impact to the consumer as an entire outer enclosure container of the type described in the above noted design patents, but with significantly less material and hence at a lower cost and in a more environmentally friendly package.

Another feature of the present invention is a means for easily removing the sleeve to permit the consumer to access the rigid base tray without too much difficulty. Such access can be provided in either of two ways. First, the overlapping portions of the panel 36 with the flap 41 can be glued together with a suitable hot melt adhesive and the free end of panel 36 may include a cutout 32 which can be easily grasped by the consumer to separate the overlapping portions of panels 36 and 41. For greater rigidity, panel 36, including the inside surface of flap 41 can be adhered to the back of the rigid base tray by a suitable adhesive such as a hot melt adhesive or the like. The nature of this adhesive is such that it should be readily separated when the consumer pulls back the panel 36 and/or the flap 41.

Figure 7:
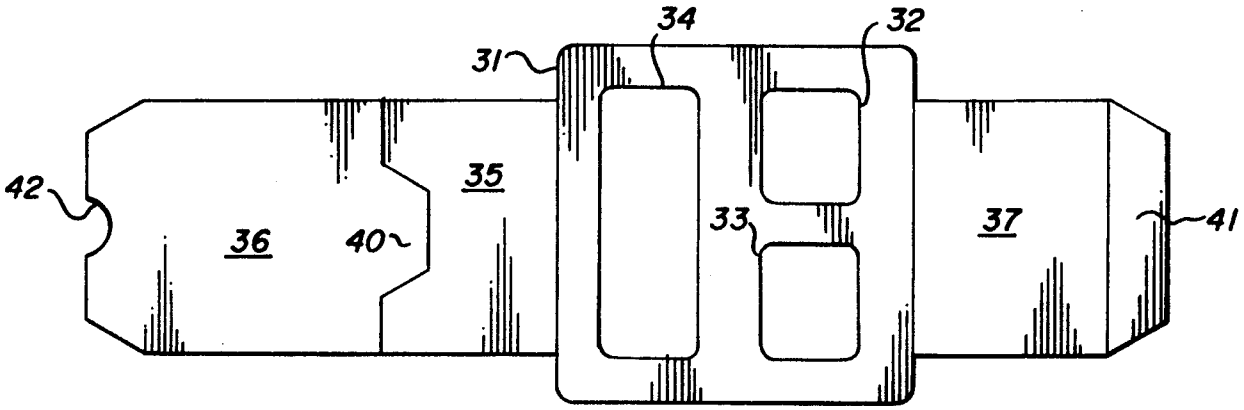
FIG. 7 illustrates the sleeve enclosure of FIGS. 3 through 6, opened up to a flat position.
Figure 12:
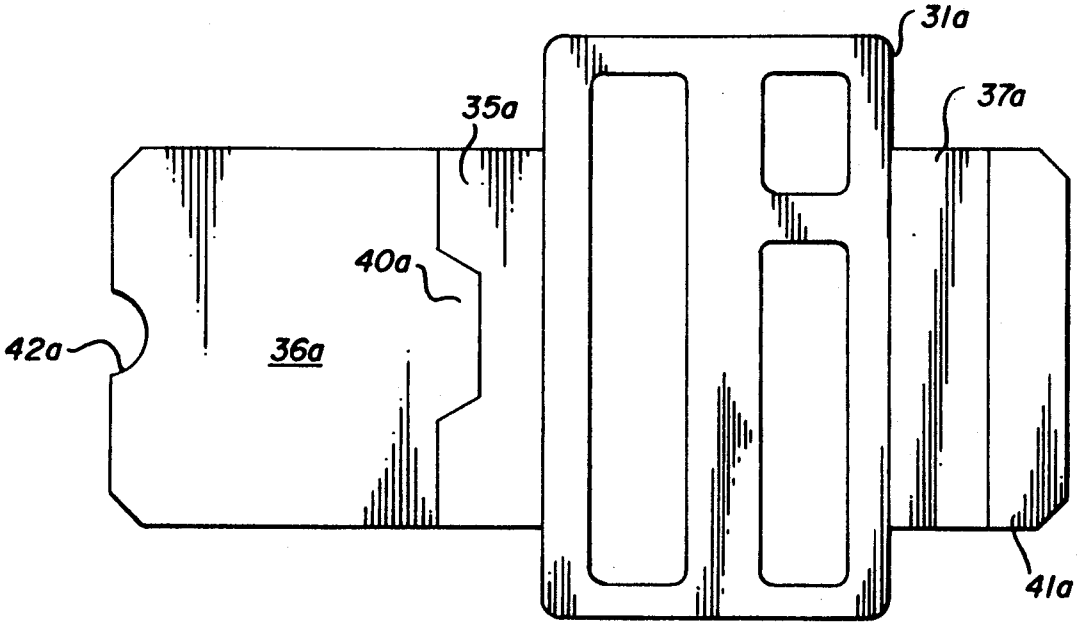
FIG. 12 illustrates the sleeve enclosure of FIGS. 8 through 11, opened up to a flat position.
Figure 7A:
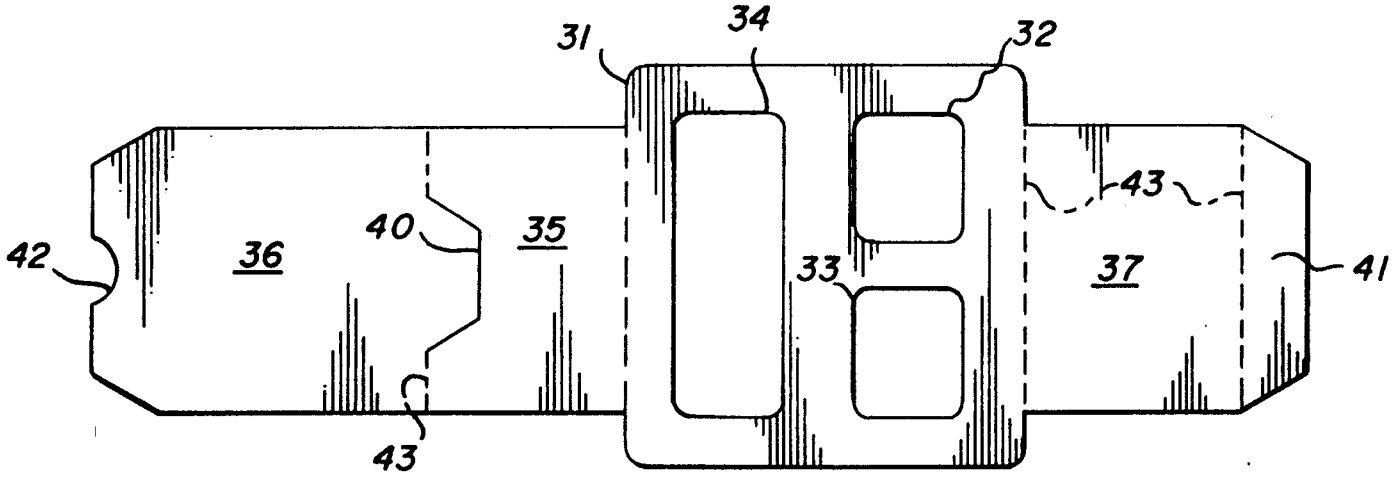
FIG. 7A is similar to FIG. 7 but illustrates a variation thereof.

A second way to provide easy opening of the sleeve enclosure is to construct the enclosure with perforations along at least some of the four fold lines separating the respective panels from each other. With this construction, the consumer would simply grasp the sleeve in the vicinity of a fold line and tear the sleeve open. The blank of FIG. 7 is shown in FIG. 7A with perforations 43 illustrated along all four fold lines.

A particular advantage can be achieved by constructing the sleeve such that even after the sleeve is opened, the back panel remains attached to the back of the rigid base tray during consumption of the food contents. This increases the rigidity of the package during usage, thereby facilitating manipulation thereof by the user while consuming the food contents. This advantage is useful on any embodiment of a rigid base tray, but may be more useful on a wider more shallow rigid base tray such as that shown in FIG. 2. In addition, any added rigidity may allow the manufacturer to reduce the thickness of the material of the rigid base tray, thereby saving material, which in turn reduces the cost of the package and is preferred for environmental purposes. Such reduction in material thickness can be achieved whether or not the back panel is removed prior to consumption, but it is more likely that such a reduction of material thickness will be practical if the back panel is designed to be retained on the package during consumption of the food contents.

Such retention of the back panel on the back of the rigid base tray during consumption can be accomplished by providing a relatively strong adhesive connection between the back panel of the sleeve and the back of the rigid base tray compartments by using any suitable adhesive, for example a hot melt adhesive, and constructing the sleeve with perforations at one or both of the fold lines at the top side and one or both fold lines at the bottom side of the package. The consumer can then break the sleeve at such perforations and remove the front panel and/or the side panels.

For proper environmental disposal of the package, the back panel can then after usage be forcibly removed from the tray either by the consumer prior to discarding the package or by separating techniques which commonly accompany recycling techniques.

The package of FIGS. 8 through 12 is similar in all respects to that of FIGS. 3 through 7A except that the sleeve of FIGS. 8 through 12 is of different dimensions, namely it has a front panel of larger length and width, and the side panels are shorter, so as to accommodate the rigid base tray 20 of FIG. 2 rather than the rigid base tray 10 of FIG. 1. Accordingly, all of the numerals in FIGS. 8 through 12 which correspond to the numerals in FIGS. 3 through 7A are the same, but with a subscript "a" added.

Figure 13:
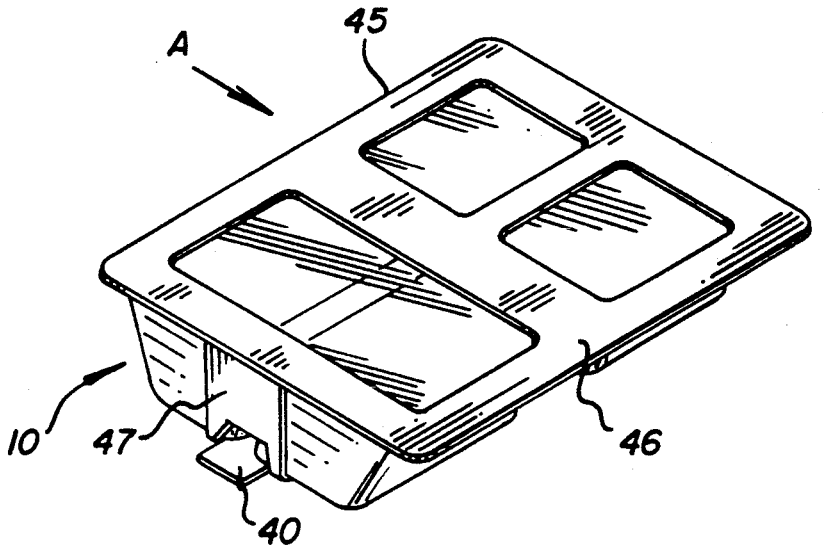
FIG. 13 is a perspective view of another embodiment of a sleeve enclosure, illustrated on the rigid base tray of FIG. 1.
Figure 14:
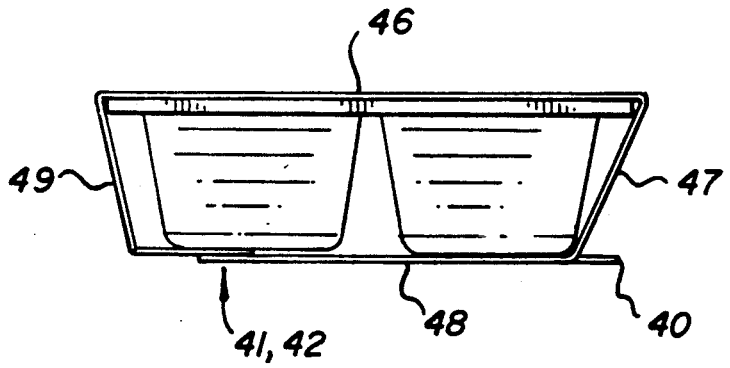
FIG. 14 is a view taken in the direction of the arrow A of FIG. 13.

FIG. 13 illustrates a variation of the present invention. Here, the front panel 45 is essentially the same as shown in FIG. 3. However, this embodiment illustrates that the lower side panel, the back panel and the upper side panel, designated here as 47, 48 and 49, respectively, can be made more narrow than as shown in FIGS. 3 through 7. There is a tradeoff in that the more narrow side and back panels reduce the rigidity of the sleeve enclosure, while on the other hand these more narrow panels lower the cost of the package and render it still more environmental friendly.

Figure 15:
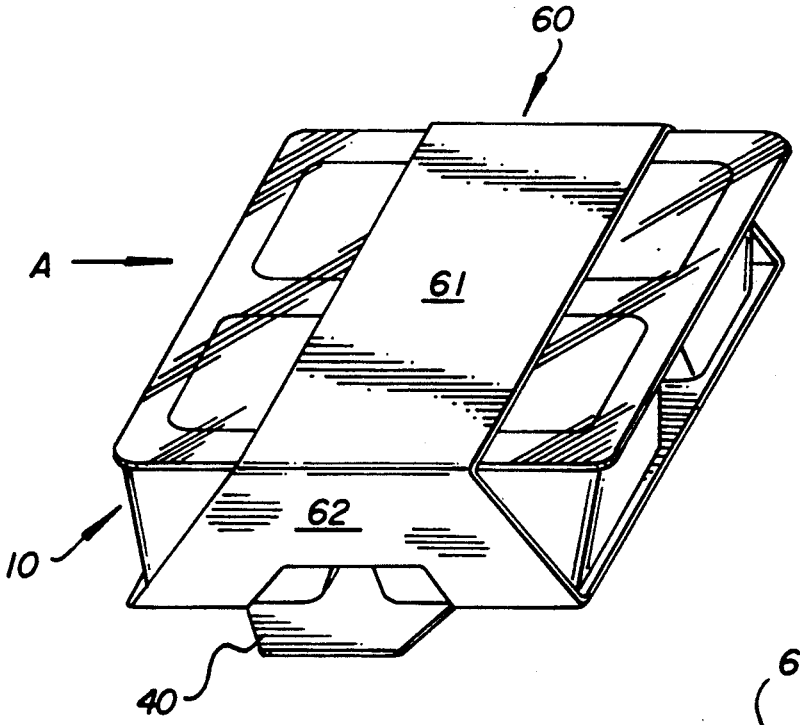
FIG. 15 is a perspective view showing another embodiment of the sleeve of the present invention.
Figure 16:
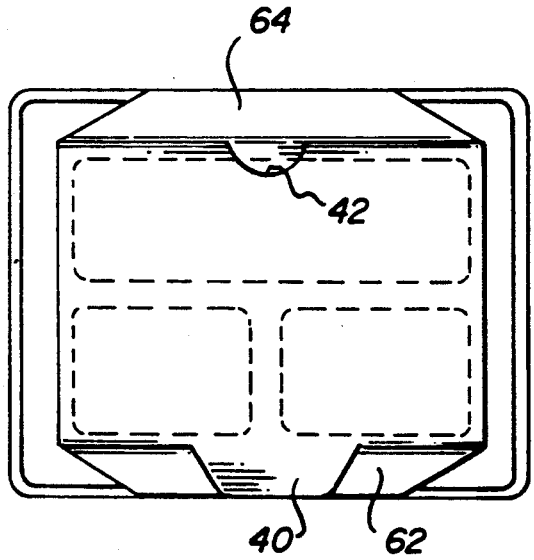
FIG. 16 is a back view of the package of FIG. 15.
Figure 17:
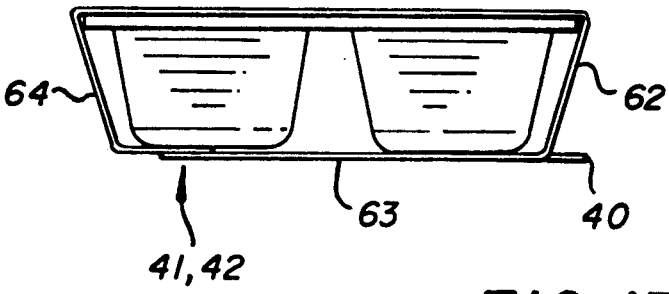
FIG. 17 is a view taken in the direction of the arrow A of FIG. 15.

As noted above, an advantage of a full faced front panel is that it strengthens the package while concurrently achieving the same visual impact as the entire outer closure container but with less packaging material. FIGS. 15 through 17 illustrate a sleeve 60 having a full faced back panel 63 and a smaller front panel 61. Also provided are lower side panel 62 and upper side panel 64. As in the earlier embodiments, this embodiment includes the stand-up cutout tab 40 and the separable overlapping panel portion 41 and the notch 42.

In this embodiment the full faced panel is provided only at the back and not in the front. The full faced back panel provides significant protection for the package. It can be glued by a suitable adhesive, such as a hot melt adhesive to the back of the compartments. Moreover this panel will prevent damage to the corners of the compartments. Whether the panel is removed before usage by the consumer or, and especially if, it is retained on the package by the user during consumption of the food contents, the additional strength provided by any back panel, but especially a full faced back panel, is sufficiently significant that the material of the rigid base tray itself may be made slightly thinner than in the absence of such a back panel. In this embodiment, visualization of the food within the compartments will be on either side of the relatively narrow front panel 61.

Figure 18:
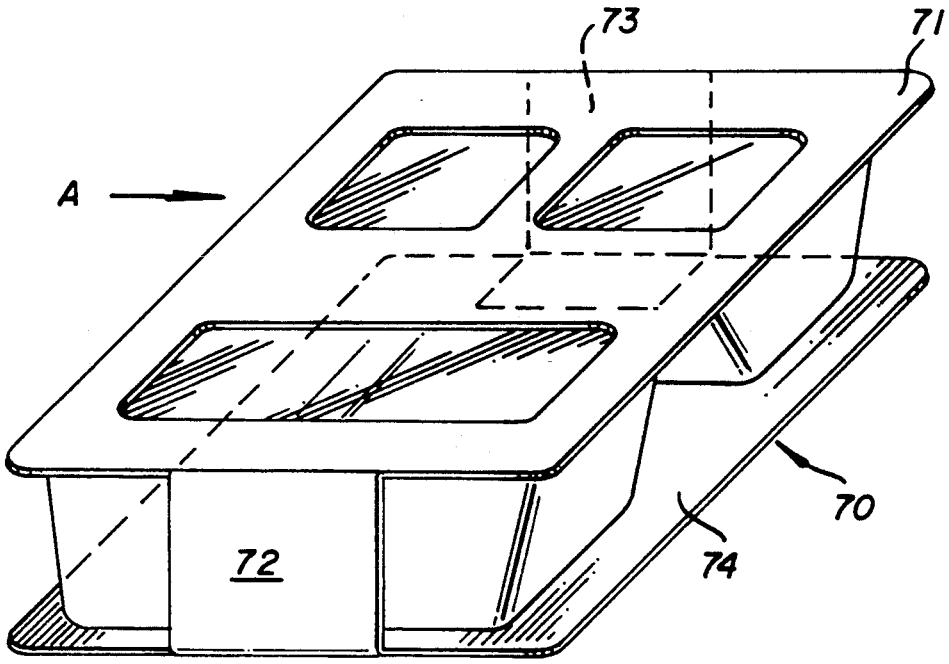
FIG. 18 is a perspective view showing another embodiment of the sleeve of the present invention.
Figure 19:
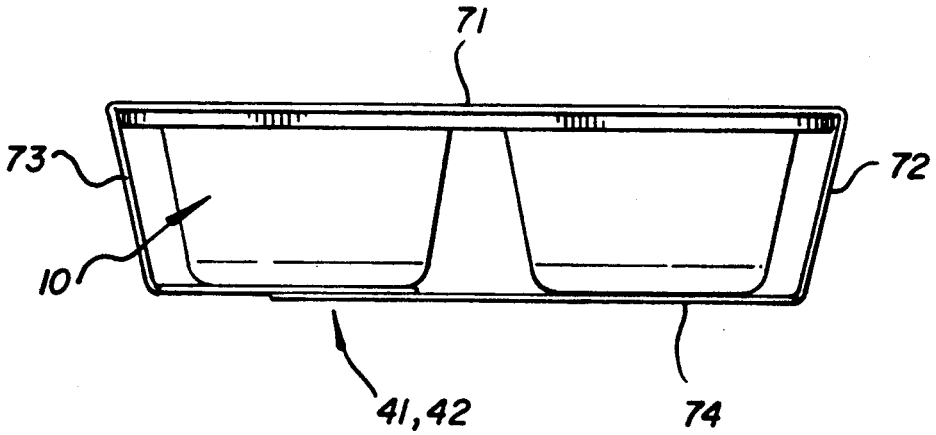
FIG. 19 is a view taken in the direction of the arrow A of FIG. 18.

FIGS. 18 and 19 illustrate another embodiment of the invention. The sleeve 70 of FIGS. 18 and 19 includes a full faced front panel 71 and a full faced back panel 74. In combination therewith are relatively narrow upper side panel 73 and lower side panel 72. This sleeve has slightly more material than some of the previously described embodiments. However, it still has less material than the outer enclosure container as shown in the design patents and it provides the advantage of a full faced front panel, i.e., strength and a visual impact identical to that of a complete outer enclosure container and the rigidity provided by a back panel 74 which, as noted above, can be adhered to the back of the rigid base tray by a suitable hot melt adhesive or the like. In the embodiment of FIG. 18, instead of the tab 40, the upper side panel 73 and the lower side panel 72 extend perpendicular to the reference plane of the rigid base tray rather than turned in as in the other embodiments. Accordingly, the panel 72 along with the adjacent edges of the panels 71 and 74 provide sufficient stability for the package to stand on the lower side thereof.

Figure 20:
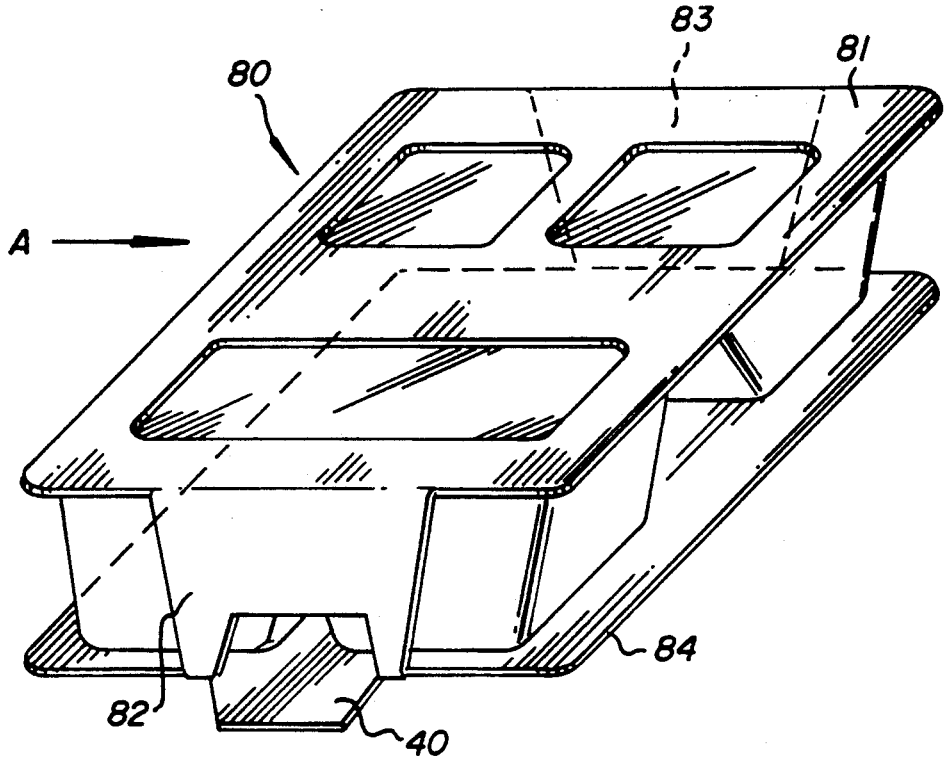
FIG. 20 is a perspective view showing another embodiment of the sleeve of the present invention.
Figure 21:
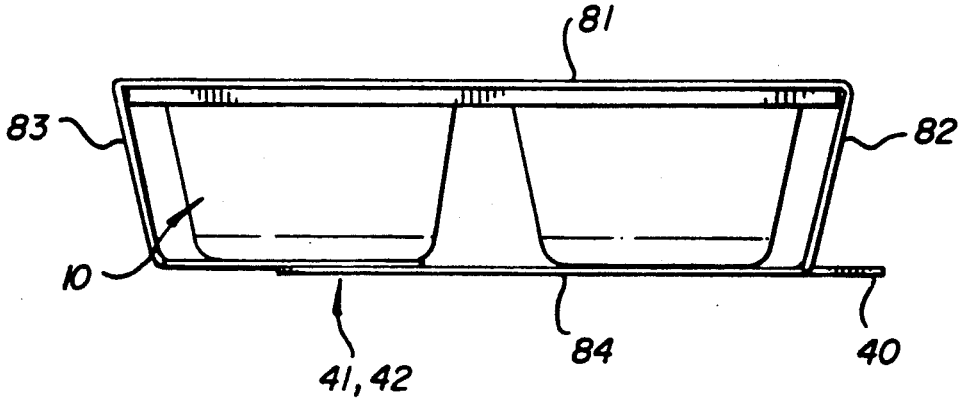
FIG. 21 is a view taken in the direction of the arrow A of FIG. 20.

FIGS. 20 and 21 show an embodiment which is similar to that of FIGS. 18 and 19 with a slight variation. The front panel 81 is similar to front panel 71. However, the upper and lower side panels 83 and 82 and the back panel 84 are similar to the earlier described embodiments in that the upper and lower side panels are turned inwardly and there is formed a stand-up tab 40.

Figure 22:
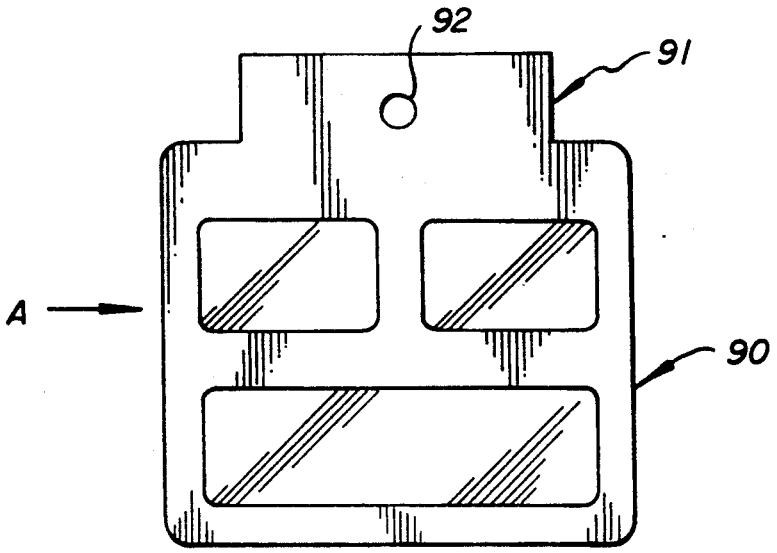
FIG. 22 is a front view similar to FIG. 3, showing another embodiment of the present invention.
Figure 24:
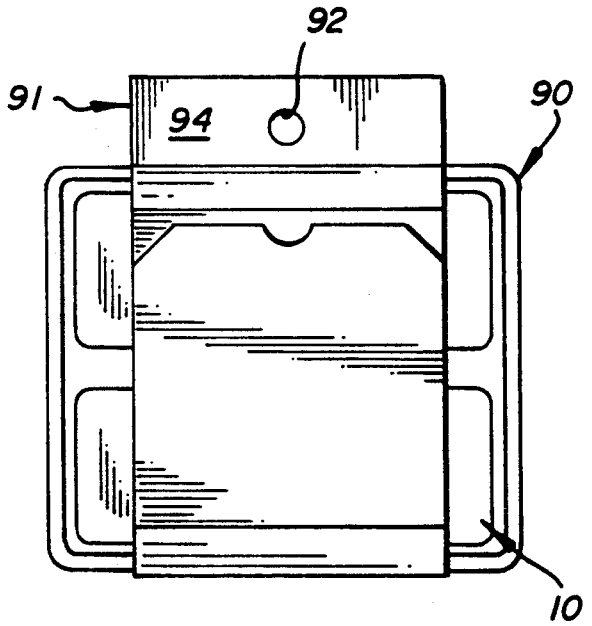
FIG. 24 is a back view of the package of FIG. 22.
Figure 23:
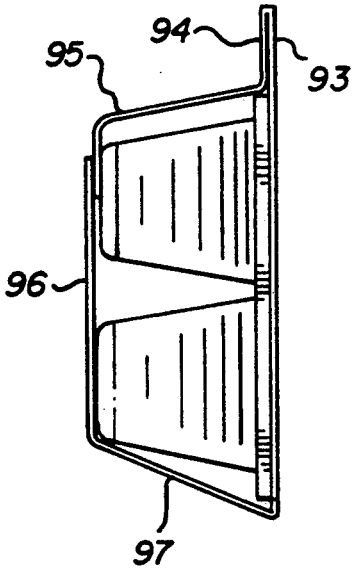
FIG. 23 is a view taken in the direction of the arrow A of FIG. 22.

FIGS. 22 through 24 illustrate an embodiment 90 of the sleeve which is similar in all respects to that of FIG. 3 except that the ability of this package to be displayed in an upright position is provided by a header 91 having an aperture 92 therethrough which will allow this package to be hung on a pegboard. Referring to FIG. 23, the header 91 can be constructed by having a portion of the sleeve 93 extend upwardly and then fold over and back down, at 94, before the sleeve turns to form the upper side 95, the back panel 96 and the lower side panel 97. Since this package is designed to be hung on a pegboard, the tab 40 is not shown therein. However, if it is desirable to provide a package with both types of stand-up features, the tab 40 could also be provided. In all other respects, the embodiment of FIGS. 22 through 24 is similar to the embodiment of FIGS. 3 through 7A and hence the details thereof will not be further discussed.

Although the invention has been described in considerable detail with respect to preferred embodiments thereof, it will be apparent that numerous modifications and variations will be apparent to those skilled in the art, without departing from the spirit and scope of the invention.

I claim:

1. A package for a food product or the like comprising:

a tray formed from a single piece of resilient material having generally flat peripheral flanges located in a reference plane and defining the periphery of the tray and internal flanges also located in the reference plane, a plurality of recessed compartments, each compartment surrounded by certain ones of said flanges and extending from the reference plane downwardly to form a product receiving recess, the tray having at least one pair of opposed upper and lower parallel edges, a thin flexible film covering the tray in said reference plane and attached to the flanges to air-tightly seal the respective recessed compartments, a sleeve wrapped completely around the tray, engaging the pair of upper and lower parallel edges, the sleeve having a front panel located against the flexible film, oppose upper and lower side panels and a back panel, at least one of the front or back panels being a full faced panel covering the entire front or back of the rigid base tray, respectively, and the front panel having open areas to permit viewing of the food product in at least some of the said compartments, the back panel being adhered to the back of the tray by a removable, hot melt adhesive.

2. A package according to claim 1, wherein the front panel is a full faced panel and it includes openings therethrough to permit viewing of the food products in the compartments.

3. A package according to claim 2, wherein the back panel is also a full faced panel.

4. A package according to claim 1, wherein the back panel is a full faced panel.

5. A package according to claim 4, wherein the front panel is of a width less than the width of the front of the tray and at least some of the compartments are visible off to the sides of the front panel.

6. A package according to claim 1, said sleeve including an upright display means permitting the package to be displayed upright with the front panel located in a vertical plane facing forwardly.

7. A package according to claim 6, said upright display means comprising a tab extending downwardly from the back panel to a line beneath and parallel to the lower parallel edge.

8. A package according to claim 1, said sleeve including a breakable means permitting easy breaking of the sleeve to remove the same from the tray.

9. A package according to claim 1, wherein the tray is essentially square, when viewed from the front, and includes an elongated larger compartment closer to the upper side and a pair of smaller compartments closer to the lower side, the upper compartment containing a farinaceous food product and at least one of the lower compartments containing a proteinaceous food product, and the front panel being a full faced panel having cutouts permitting viewing of products in each of the three compartments.

10. A package according to claim 1, wherein the rigid base tray is an elongated rectangle, when viewed in the direction of its front face, the longer edges of the rectangular tray being the opposed upper and lower parallel edges, the tray having at least six separate compartments, at least one of said compartments including a farinaceous food product and at least two of the other compartments including a proteinaceous food product, and the front panel being a full faced panel with cutouts therethrough permitting viewing of product in at least four of the compartments of the tray.

11. A package for a food product or the like comprising:

a tray formed from a single piece of resilient material having generally flat peripheral flanges located in a reference plane and defining the periphery of the tray and internal flanges also located in the reference plane, a plurality of recessed compartments, each compartment surrounded by certain ones of said flanges and extending from the reference plane downwardly to form a product receiving recess, the tray having at least one pair of opposed upper and lower parallel edges, a thin flexible film covering the tray in said reference plane and attached to the flanges to air-tightly seal the respective recessed compartments, a sleeve wrapped completely around the tray, engaging the pair of upper and lower parallel edges, the sleeve having a front panel located against the flexible film, opposed upper and lower side panels and a back panel, the front panel having open areas permitting viewing of the food products in each of said compartments, a stand-up means permitting the package to stand up on the lower side with the front panel located in a vertical plane facing forwardly, said stand-up means comprising a tab formed in and cut out of the lower side panel, the cutout tab being integral and coplaner with the back panel, the tab extending outwardly to a line beneath and parallel to the lower parallel edge.

12. A package according to claim 11, wherein at least one of said front or back panels is a full faced panel, covering the front or back of the tray, respectively.

13. A package according to claim 12, wherein both the front and the back panels are full faced panels, the front panel having cutouts to permit viewing of food products in at least some of the said compartments and the back panel being adhered to the back of the tray.

14. A package for a food product or the like comprising:

a tray formed from a single piece of resilient material having generally flat peripheral flanges located in a reference plane and defining the periphery of the tray and internal flanges also located in the reference plane, a plurality of recessed compartments, each compartment surrounded by certain ones of said flanges and extending from the reference plane downwardly to form a product receiving recess, the tray having at least one pair of opposed upper and lower parallel edges, a thin flexible film covering the tray in said reference plane and attached to the flanges to air-tightly seal the respective recessed compartments, a sleeve wrapped completely around the tray, engaging the pair of upper and lower parallel edges, the sleeve having a front panel located against the flexible film, opposed upper and lower side panels and a back panel, the front panel having open areas permitting viewing of the food products in each of the compartments, and said sleeve including a breakable means permitting easy breaking of the sleeve to allow access to the tray to consume the contents thereof, the breakable means including perforation lines along at least one fold line on each of the upper and lower sides of the package, and the back panel being attached to the back of the tray with sufficient adherence to remain thereon during consumption of the product within the tray.

15. A package according to claim 14, wherein said breakable means also includes overlapping portions of the sleeve adhered together by a breakable adhesive.

16. A package for a food product or the like comprising:

a tray formed from a single piece of resilient material having generally flat peripheral flanges located in a reference plane and defining the periphery of the tray and internal flanges also located in the reference plane, a plurality of recessed compartments, each compartment surrounded by certain ones of said flanges and extending from the reference plane downwardly to form a product receiving recess, the tray having at least one pair of opposed upper and lower parallel edges, a thin flexible film covering the tray in said reference plane and attached to the flanges to air-tightly seal the respective recessed compartments, a sleeve wrapped completely around the tray, engaging the pair of upper and lower parallel edges, the sleeve having a front panel located against the flexible film, opposed upper and lower side panels and a back panel, at least the back panel being a full faced panel covering the entire back of the rigid base tray, and the front panel having open areas to permit viewing of the food product in at least some of said compartments, and wherein the front panel is of a width less than the width of the front of the tray and at least some of the compartments are visible off to the sides of the front panel.

17. A package for a food product or the like comprising:

a tray formed from a single piece of resilient material having generally flat peripheral flanges located in a reference plane and defining the periphery of the tray and internal flanges also located in the reference plane, an plurality of recessed compartments, each compartment surrounded by certain ones of said flanges and extending from the reference plane downwardly to form a product receiving recess, the tray having at least one pair of opposed upper and lower parallel edges, a thin flexible film covering the tray in said reference plane and attached to the flanges to air-tightly seal the respective recessed compartments, a sleeve wrapped completely around the tray, engaging the pair of upper and lower parallel edges, the sleeve having a front panel located against the flexible film, opposed upper and lower side panels and a back panel, at least one of the front or back panels being a full faced panel covering the entire front or back of the rigid base tray, respectively, and the front panel having open areas to permit viewing of the food product in at least some of the said compartments, said sleeve including an upright display means permitting the package to be displayed upright with the front panel located in a vertical plane facing forwardly, said upright display means comprising a tab extending downwardly from the back panel to a line beneath and parallel to the lower parallel edge.

18. A package according to claim 17, wherein the upright display means comprises a header projecting upwardly from the upper side of the package and including a peg hole therein for hanging the package on a peg.

* * * * *